US010017370B2

(12) United States Patent
Zoni et al.

(10) Patent No.: US 10,017,370 B2
(45) Date of Patent: Jul. 10, 2018

(54) MACHINE AND METHOD FOR FILLING CONTAINERS

(71) Applicant: SIDEL PARTICIPATIONS S.A.S., Octeville-sur-Mer (FR)

(72) Inventors: Roberto Zoni, Parma (IT); Annalisa Malfatto, Parma (IT); Mirko Rossi, Parma (IT); Tommaso Tegoni, Parma (IT)

(73) Assignee: SIDEL PARTICIPATIONS S.A.S, Octeville-sur-Mer (FR)

( * ) Notice: Subject to any disclaimer, the term of this patent is extended or adjusted under 35 U.S.C. 154(b) by 105 days.

(21) Appl. No.: 15/200,112

(22) Filed: Jul. 1, 2016

(65) Prior Publication Data

US 2017/0015540 A1 Jan. 19, 2017

(30) Foreign Application Priority Data

Jul. 16, 2015 (EP) ..... 15306160

(51) Int. Cl.

| | |
|---|---|
| ***B65B 31/00*** | (2006.01) |
| ***B67C 3/06*** | (2006.01) |
| ***B65C 3/16*** | (2006.01) |
| ***B67C 3/10*** | (2006.01) |
| ***B65C 3/26*** | (2006.01) |
| ***B67C 3/00*** | (2006.01) |

(Continued)

(52) U.S. Cl.

CPC ..... *B67C 3/06* (2013.01); *B65C 3/16* (2013.01); *B65C 3/26* (2013.01); *B67C 3/007* (2013.01); *B67C 3/10* (2013.01); *B67C 3/225* (2013.01); *B67C 3/242* (2013.01); *B67C 3/26* (2013.01); *B67C 2003/2648* (2013.01)

(58) Field of Classification Search

CPC .. B67C 3/06; B67C 3/26; B67C 3/225; B67C 3/007; B67C 3/242; B67C 3/10; B67C 2003/2648; B65C 3/26; B65C 3/16

See application file for complete search history.

(56) References Cited

FOREIGN PATENT DOCUMENTS

| | | |
|---|---|---|
| EP | 0414031 A1 | 2/1991 |
| EP | 2749501 A1 | 7/2014 |
| EP | 2889229 A1 | 7/2015 |

OTHER PUBLICATIONS

Extended European Search Report dated Jan. 13, 2016, by the European Patent Office in counterpart European Patent Application No. 15306160.1 (7 pages).

*Primary Examiner* — Jason K Niesz

(74) *Attorney, Agent, or Firm* — Finnegan, Henderson, Farabow, Garrett & Dunner, L.L.P.

(57) ABSTRACT

A machine for filling containers, each container having a longitudinal axis, the machine comprising: a conveying device; at least one handling unit including a support device configured to receive and retain a container and at least one filling device selectively activated for feeding a pourable product into the container while the at least one handling unit travels along the transfer path; a pressurizing circuit; a decompression circuit; at least one actuating device; and a control unit configured to: control activation and deactivation of the at least one filling device and the at least one actuating device; control connection of the pressurization circuit and the decompression circuit with the container; and simultaneously maintain the at least one actuating device in an active state while the decompression circuit is in communication with the container so as to rotate the container about the longitudinal axis during decompression.

18 Claims, 8 Drawing Sheets

(51) Int. Cl.

| | |
|---|---|
| ***B67C 3/22*** | (2006.01) |
| ***B67C 3/24*** | (2006.01) |
| ***B67C 3/26*** | (2006.01) |

FIG. 4
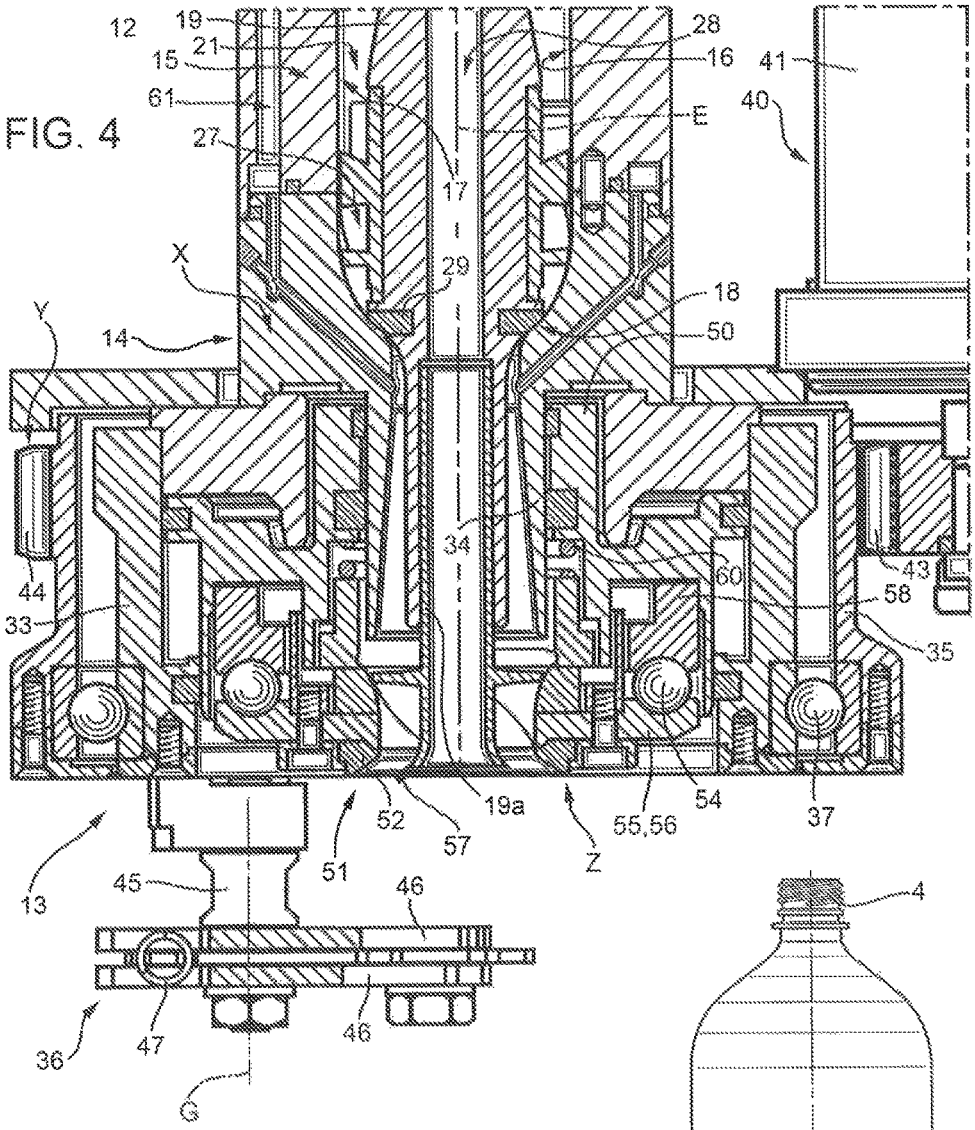
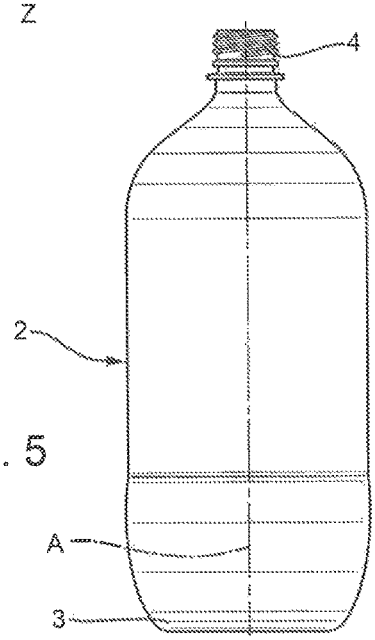
FIG. 5

MACHINE AND METHOD FOR FILLING CONTAINERS

CROSS-REFERENCE TO RELATED APPLICATIONS

This application claims the benefit of priority of European Patent Application No. 15306160.1, filed on Jul. 16, 2015, which is incorporated herein by reference.

TECHNICAL FIELD

The present invention relates to a machine and a method for filling containers with pourable products, in particular carbonated liquids (such as sparkling water, soft drinks and beer), still water or beverages (including juices, teas, sport drinks, liquid cleaners, wine, etc), emulsions, suspensions, high viscosity liquids, etc.

The present invention may be also used to particular advantage for any type of container, such as containers or bottles made of glass, plastics, aluminum, steel and composites.

BACKGROUND ART

As known, many pourable products are sold in a wide range of bottles or containers, which are sterilized, filled and closed in container handling plants typically including a plurality of processing stations or machines, such as rinsing machines, filling machines, capping machines and labelling machines.

These processing stations can be defined by linear machines or, more frequently, by carousel-type machines. The following description will refer to carousel-type machines only, although this is in no way intended to limit the scope of protection of the present application.

The containers to be handled are generally fed to and removed from these machines by means of a transport system including star wheels and linear conveyors.

Known container handling plants are therefore fairly bulky and allow little freedom of choice in terms of layout; moreover, this kind of plants requires quite complicated adjustments to synchronize the different processing stations and entails relatively high operating and maintenance costs.

Another problem posed in respect of known filling machines is the formation of foam at the end of the operation of filling the container.

This problem is mainly caused by the fact that, for reasons of economy, commercial containers are not such larger than the volume required for accommodating of the contents. Thus, during filling operations, which have to be carried out at high speed, it is common for some amount of liquid in the form of foam to bubble over the top of the container prior to the container being capped or sealed. The product loss can be as high as ten percent, which translates into higher cost for the consumer or lower profitability for the bottler, or both.

To reduce this product loss, some filling machines include a dwell station that allows for the product foam in a recently filled container to settle prior to capping.

Other filling machines include a short suction pipe adapted to be introduced into the container to be sealed, and a suction system whereby the foam over the top surface of the liquid is removed and optionally recycled into the product reservoir.

Some filling machines may also use blast nozzles for blowing any drops and residual foam from the surfaces to be sealed or capped.

Some filling machines reduce the temperature of the liquid at the mixing tanks or other reservoirs to reduce foaming.

In certain cases, the containers are purposefully overfilled to compensate for lost product in the form of foam and thereby achieve the desired net fill volume, which results in undesirable product loss.

Other possible solutions are based on the use of ultrasonic waves for collapsing the foam; in practice, the portion of liquid forming the foam again becomes part of the liquid content of the container rather than being wasted.

In order to solve the two above-described problems (bulky container handling plants and formation of foam at the end of the filling operation), the applicant has recently proposed to perform both the filling and the labelling operation on the same carousel as well as to rotate the containers during filling (see EP-A-2749501).

The applicant has in fact observed that, by rotating each container about its axis while the same container is filled with the pourable product and is transported in a revolution motion by the carousel, it is possible to obtain the following effects:

- the centrifugal force caused by this double rotation generates an additional pressure on the pourable product in the container, which entraps the carbon dioxide into the product; and
- the pourable product comes down into the container along the lateral wall thereof instead of centrally.

Both these effects permits to obtain a significant reduction in the formation of foam at the end of the filling operation.

Though satisfactory, the recently-proposed solution still leaves room for further improvements, especially as to achieve a further reduction of the formation of foam in the containers subjected to the filling operation, without using additional external tools.

DISCLOSURE OF INVENTION

It is an object of the present invention to provide a machine and a method for filling containers, designed to eliminate at least one of the aforementioned drawbacks, and which is cheap and easy to implement.

According to the present invention, there is provided a machine for filling containers as claimed in claim 1 and a method for filling containers as claimed in claim 12.

BRIEF DESCRIPTION OF THE DRAWINGS

Two non-limiting embodiments of the present invention will be described by way of example with reference to the accompanying drawings, in which:

FIG. 4 shows a larger-scale, sectioned side view, with parts removed for clarity, of a detail of the handling assembly of FIG. 3;

FIG. 5 shows a front view of the bottle of FIG. 3;

BEST MODE FOR CARRYING OUT THE INVENTION

Figure 1:
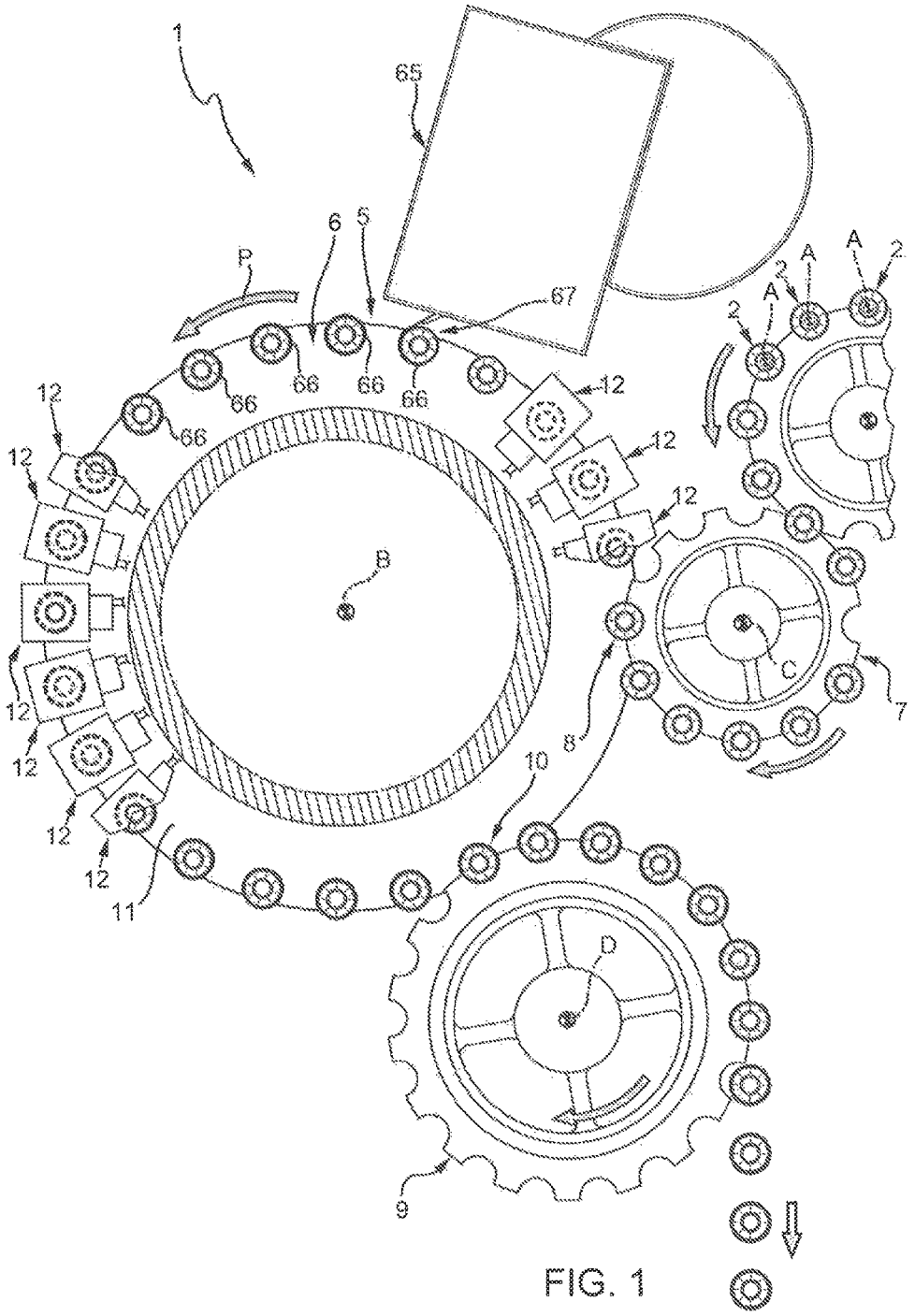
FIG. 1 shows a schematic top plan view, with parts removed for clarity, of a first embodiment of a machine according to the present invention for filling bottles with a pourable product.

Number 1 in FIG. 1 indicates as a whole a machine for filling containers, in particular bottles 2, with pourable products, in the example shown either carbonated liquids, such as sparkling water, soft drinks and beer, or non-carbonated liquids, such as still water or beverages, including juices, teas, sport drinks, liquid cleaners, wine, etc.

Figure 3:
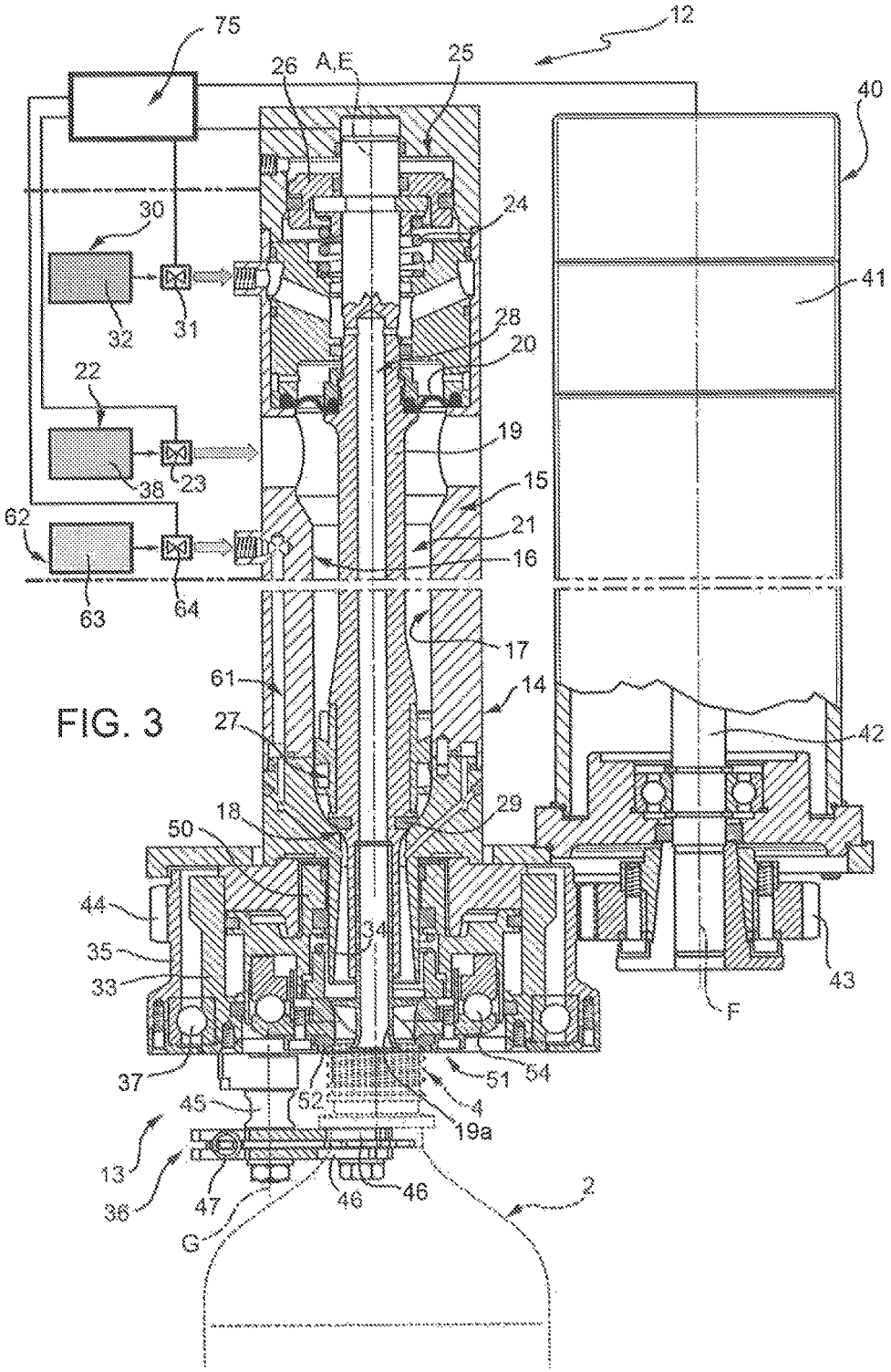
FIG. 3 shows a larger-scale, sectioned side view, with parts removed for clarity, of a handling assembly of the FIG. 1 machine for carrying and filling a relative bottle.

As visible in FIGS. 3 and 5, each bottle 2 has a longitudinal axis A, is bounded at the bottom by a bottom wall 3, substantially perpendicular to axis A, and has a top neck 4 substantially coaxial with the axis A itself and defining an inlet/outlet mouth.

In the example shown, the bottles 2 filled by machine 1 are made of plastics; however, machine 1 may be also used for other types of containers, such as containers made of aluminum, steel, glass and composites. Moreover, the containers used in machine 1 may be filled with any type of pourable product, including emulsions, suspensions and high viscosity liquids.

Machine 1 comprises a conveying device 5 that serves not only to fill the bottles 2 but also to label them.

Figure 2:
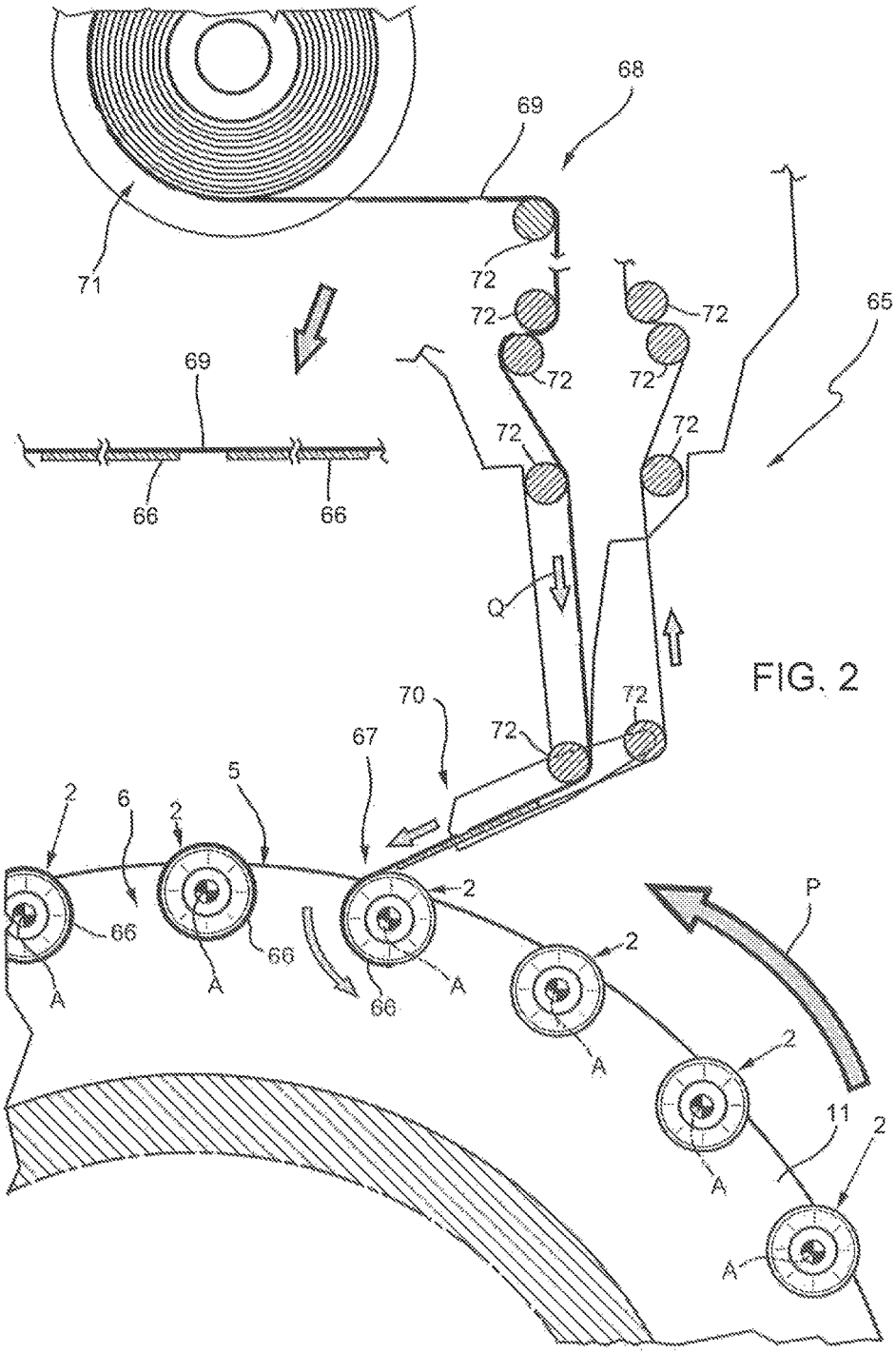
FIG. 2 shows a larger-scale top plan view, with parts removed for clarity, of a part of the FIG. 1 machine.

In the preferred embodiment as illustrated in FIGS. 1 and 2, the conveying device 5 comprises a carousel 6, which is mounted to rotate continuously (anticlockwise in FIGS. 1 and 2) about a vertical axis B perpendicular to the FIG. 1 plane. The carousel 6 receives a succession of empty bottles 2 from an input star wheel 7, which is connected to carousel 6 at a first transfer station 8 and is mounted to rotate continuously about a respective longitudinal axis C parallel to axis B. The carousel 6 releases a succession of filled and labelled bottles 2 to an output star wheel 9, which is connected to carousel 6 at a second transfer station 10 and is mounted to rotate continuously about a respective longitudinal axis D parallel to axes B and C.

Machine 1 further comprises a plurality of handling units 12, which are equally spaced angularly about axis B, are mounted along a peripheral portion 11 of carousel 6 and are moved by the carousel 6 itself along a transfer path P extending about axis B and through stations 8 and 10.

As shown in the FIGS. 1 to 4, each handling unit 12 comprises a support device 13 configured to receive and retain a relative bottle 2 in a vertical position, in which such bottle 2 has its axis A parallel to the axis B of carousel 6, and a filling device 14 for feeding the pourable product into the bottle 2 itself as the support device 13 travels along transfer path P.

Each filling device 14 is conveniently arranged above the bottle 2 to be filled and each support device 13 projects downwards from the relative filling device 14 and supports the bottle 2 itself in a suspended position.

As the handling units 12 are completely identical to each other, only one will be described in detail hereafter, for the sake of clarity and simplicity.

With particular reference to FIGS. 3 and 4, filling device 14 comprises a vertical hollow post 15 with a cylindrical shape, which has a longitudinal axis E, parallel to axis B, and is fixed to the peripheral portion 11 of the carousel 6.

Post 15 is radially delimited by an inner surface 16 comprising an upper wide portion 17 and a lower narrow portion 18, and is engaged in a sliding manner by a shutter 19 with a tubular shape, which is mounted inside the post 15 coaxial to the axis E.

Shutter 19 projects downwards from a lower opening of post 15, and is coupled to the latter by means of a deformable annular membrane 20, which is in turn interposed between the post 15 and the shutter 19 themselves.

Shutter 19 defines, together with post 15, an annular feeding conduit 21, which extends between post 15 and shutter 19 and is connected, through a product circuit 22 (known per se and only schematically shown) and an ON/OFF valve 23, to a tank 38 (also known per se and schematically shown) containing the pourable product to be fed into the bottles 2.

Shutter 19 is provided, on its outer surface, with an annular elastomeric gasket 29 configured to cooperate in use with lower narrow portion 18 of inner surface 16 of post 15; shutter 19 also has a lower tubular end portion 19*a* extending downwards coaxially with axis E from the portion provided with gasket 29.

Shutter 19 is axially movable between a lowered closing position (FIGS. 3 and 4), in which gasket 29 of the shutter 19 is arranged in contact with lower narrow portion 18 of inner surface 16 of post 15 so as to be coupled to the latter in a fluid-tight manner and close conduit 21, and a raised opening position (not shown), in which the conduit 21 itself is open.

Shutter 19 is moved to its raised opening position—and normally kept there—by a spring 24, which is mounted between the post 15 and the shutter 19 coaxial to axis E, and is moved to its lowered closing position, against the action of the spring 24, by an actuating cylinder 25.

More specifically, actuating cylinder 25 is arranged within post 15 coaxial to axis E, is provided with a piston 26, which is coupled to shutter 19 in an axially and angularly fixed manner, and is connected to a known pneumatic device, which is not shown.

By setting valve 23 in an open condition and shutter 19 in the raised opening position, the pourable product can flow within the relative bottle 2 so as to define a filling operation thereof.

Shutter 19 also has a swirler 27, which is obtained on the outer surface of the shutter 19 itself, and extends along—and around—axis E, so as to cause the pourable product fed along conduit 21 to have a swirling movement.

Shutter 19 defines an inner feeding conduit 28, which is connected, through a pressurization circuit 30 (known per se and only schematically shown) and an ON/OFF valve 31, to a chamber 32 (also known per se and schematically shown) formed in the carousel 6 and filled with a pressurization fluid, e.g. carbon dioxide.

By setting valve 31 in an open condition, it is possible to pressurize the relative bottle 2 carried by the handling unit 12 to a given pressure value higher than the atmospheric pressure. This pressurizing step serves to two purposes:

to make each bottle 2 sufficiently rigid for a labelling operation, which is carried out on the same carousel 6 and will be described in detail later on; and in case of a filling operation to be performed with a carbonated product with or without a labelling operation, to take each bottle 2 to the requested condition for filling.

It is pointed out that the pressure values required for filling a bottle 2 with a carbonated product may be different and in particular higher than the pressure values required only to make the bottle 2 sufficiently rigid for a labelling operation.

Filling device 14 also comprises a cylinder 33 with a tubular shape, which extends around a lower narrow end 34 of post 15, is mounted coaxial to axis E, and is coupled to the post 15 itself in an angularly and axially fixed manner.

Support device 13 comprises a substantially cylindrical support bell 35 of axis E, which is externally coupled to cylinder 33 in an axially fixed position and in a rotary manner about the axis E itself, and a gripping member 36 projecting downwards from the bell 35 and configured to retain a relative bottle 2 by the top neck 4.

In particular, bell 35 extends coaxially around cylinder 33 and is arranged with its concavity facing upwards.

More specifically, bell 35 is coupled to cylinder 33 by interposing a rolling bearing 37, so as to rotate around axis E relative to the cylinder 33 itself and under the thrust of an actuating device 40, in turn extending on one side of filling device 14.

As clearly visible in FIG. 3, actuating device 40 comprises an electric motor 41, which is fixed to portion 11 of carousel 6 on one side of post 15, and is provided with an output shaft 42 having a longitudinal axis F that is parallel to axis E.

Shaft 42 is coupled to bell 35 by means of a pair of gears 43, 44, one of which is angularly secured to the shaft 42 and the other is formed on the outer surface of the bell 35 itself.

Gripping member 36 comprises a support arm 45, which projects downwards from bell 35, is fixed to the bell 35 itself and supports a pair of holding jaws 46, which are configured to hold a relative bottle 2 in correspondence to its top neck 4.

In particular, support arm 45 projects from a bottom surface of bell 35 in an eccentric position with respect to axis E.

Jaws 46 are mounted under arm 45 and are hinged to the arm 45 itself so as to rotate, relative to the latter, around a fulcrum axis G, which is parallel to axis E.

Jaws 46 are normally set in a clamping position under the thrust of a spring 47, which is interposed between the jaws 46 themselves; in use, jaws 46 are moved to a release position by the thrust exerted thereon by the relative bottle 2 during its insertion into gripping member 36 or its extraction from the gripping member 36.

Cylinder 33 internally houses a pneumatically operated piston 50 (FIG. 4), which is mounted so as to slide inside the cylinder 33 itself, extends around lower end 34, and defines part of a filling head 51.

In particular, filling head 51 axially projects downwards from post 15 and further comprises an annular elastomeric gasket 52, which has an annular shape coaxial to axis E, faces, in use, top neck 4 of the relative bottle 2, and is coupled to piston 50 in an axially fixed manner, so as to be moved by the piston 50 between a lowered operating position, in which the gasket 52 is coupled to the top neck 4 in a fluid-tight manner, and a raised rest position, in which the gasket 52 is arranged at a given distance from the top neck 4 itself.

In addition, gasket 52 is coupled to piston 50 in a rotary manner by interposing a rolling bearing 54, so as to rotate, relative to the piston 50 itself, around axis E under the thrust of the relative bottle 2.

To this regard, it should be pointed out that gasket 52 is angularly integral to a lower rotary race 55 of bearing 54 and that the race 55 radially extends above the gasket 52 so as to define a rotary ring 56 of a sliding mechanical gasket 57.

In particular, mechanical gasket 57 allows piston 50 and gasket 52, namely the angularly fixed part and the rotary part of filling head 51, to be coupled to one another in a fluid-tight manner and comprises, furthermore, a further ring 58, which is mounted above ring 56 coaxial to axis E.

Ring 58 is fixed to the lower free end of a sleeve 59, which is coupled in an angularly fixed and axially sliding manner to piston 50, and is kept in contact with ring 56 by a spring 60, which is interposed between the piston 50 and the sleeve 59 themselves.

At transfer stations 8, 10, the position of each gripping member 36 and, hence, of the relative jaws 46 around the relative axis E is selectively controlled so as to guarantee a correct pick-up and a correct release of the bottles 2, respectively.

The angular position of each gripping member 36 can be selectively controlled by means of an encoder, which is associated with the relative electric motor 41, or by means of a cam mechanism, which cooperates with the relative bell 35.

According to another possible embodiment not shown, gripping members 36 can be removed and replaced by respective lower plates, which are arranged under the relative bottles 2 and are motor-operated so as to rotate around the relative axes E, and the rotation motion is transmitted to filling heads 51 by means of the bottles 2 themselves. In this case, when bottles 2 are made of PET, the bottles 2 are pressurized through conduit 28 so as to have a sufficient stiffness, preferably before being caused to rotate around the relative axes E.

As shown in FIGS. 3 and 4, post 15 further defines a decompression conduit 61 connecting an annular volume V, formed between lower narrow end 34 of the post 15 and lower end portion 19*a* of shutter 19, with a decompression circuit 62 (known per se and only schematically shown), in turn connected to a discharge device 63 (also known per se and only schematically shown) through an ON/OFF valve 64.

As a result of the described structure, each handling unit 12 is configured not only to support and fill a relative bottle 2 but also to rotate such bottle 2 about its axis A during its movement along transfer path P together with carousel 6. This kind or rotary motion is imparted to each bottle 2 by electric motor 41 and gripping member 36 of the relative handling unit 12.

In practice, each bottle 2 has, in use, a revolution motion about axis B together with carousel 6 and a rotary motion about its own axis A as a result of the torque imparted by the relative electric motor 41 and gears 43, 44 to the relative gripping member 36.

As a result of the described structure of each handling unit 12, the relative post 15 and cylinder 33 define a fixed portion X of such handling unit 12, whilst the relative bell 35 and the gripping member 36 define an active rotary portion Y of the handling unit 12 itself, capable of imparting a rotary motion to the relative bottle 2; in addition, the gasket 52 and the rotary race 55 define a passive rotary portion Z of the relative handling unit 12 as such components are dragged into rotation in use by the relative bottle 2.

With reference to FIGS. 1 and 2, machine 1 further comprises a labelling unit 65 arranged peripherally with respect to carousel 6 and configured to feed a succession of labels 66 to the respective handling units 12 while such units are advanced along transfer path P by carousel 6 and pass by the labelling unit 65.

As visible in FIG. 1, labelling unit 65 is arranged between input star wheel 7 and output star wheel 9 along transfer path P; more specifically, labels 66 are supplied to handling units 12 at a transfer station 67 interposed between transfer stations 8 and 10 along transfer path P and preferably arranged closer to transfer station 8 than transfer station 10.

With particular reference to FIG. 2, labelling unit 65 basically comprises a supply assembly 68 for supplying a web 69, provided with the labels 66, along a path Q towards carousel 6, and an interaction device 70 interacting with the web 69 at transfer station 67 to separate each label 66 from the rest of the web 69 and supplying such label 66 to the handling unit 12 passing by the transfer station 67.

In the example shown, labels 66 are of the pressure-sensitive type and are originally affixed to web 69 at spaced apart positions.

Supply assembly 68 basically comprises a supply reel 71, off which web 69 is unwound, and a plurality of rollers 72, about which the web 69 is wound to be guided and supplied along path Q; at least one of the rollers 72 is motorized to drive web 69 off the supply reel 71 and towards transfer station 67 of carousel 6.

In the embodiment shown in FIGS. 1 and 2, interaction device 70 comprises a peeler blade 73, over which the web 69 is pulled, thereby causing each label 66 to separate from the web 69, which is then disposed of. In practice, at transfer station 67, labels 66 are sequentially peeled off web 69 about peeler blade 73 and applied to corresponding bottles 2 sequentially arriving at transfer station 67 as a result of the advancement of handling units 12 by carousel 6.

According to a possible alternative not shown, labels 66 may be integral parts of a web, which is then cut by cutting means at the transfer station 67 to feed a succession of labels 66 to the bottles 2 on carousel 6.

In order to allow application of each label 66 on the corresponding bottle 2, the latter is rotated about its axis A by switching electric motor 41 to an active state.

As it will be explained in greater detail hereafter, the application of each label 66 on the corresponding bottle 2 is performed after pressurization of such bottle 2 by opening valve 31 of the relative pressurization circuit 30.

Machine 1 further comprises a control unit 75 connected to electric motor 41, piston 26 and ON/OFF valves 23, 31 and 64 of each handling unit 12.

Control unit 75 is configured to set each electric motor 41 in the active state in order to rotate the relative gripping member 36 supporting a relative bottle 2 during labelling and filling thereof with the pourable product.

Angular speed imparted to each bottle 2 during application of one relative label 66 is preferably higher than that imparted to the same bottle 2 during filling with the pourable product.

In order to obtain rotation of each bottle 2 during filling thereof with the pourable product, control unit 75 simultaneously maintains the shutter 19 of the relative handling unit 12 in the upper opening position, the relative valve 23 in the open condition and the relative electric motor 41 in the active state, so as to rotate the relative gripping member 36 about the respective axis E.

By rotating each bottle 2 about its axis A while the same bottle 2 is filled with the pourable product by the relative filling device 14 and is transported in a revolution motion along transfer path P by carousel 6, it is possible to obtain the following effects:

- the centrifugal force caused by this double rotation generates an additional pressure on the pourable product in the bottle 2, which entraps the carbon dioxide into the product; and
- the pourable product comes down into the bottle 2 along the lateral wall thereof instead of centrally.

Both these effects permits to obtain a significant reduction in the formation of foam at the end of the filling operation.

According to an important aspect of the present invention, control unit 75 is also configured to switch each electric motor 41 to the active state so as to rotate the relative gripping member 36, in turn supporting a relative bottle 2, during the decompression step, i.e. while such bottle 2 is put in connection, by opening the relative valve 64, with the discharge device 63.

The applicant has observed that this further rotation imparted to each bottle 2 during the decompression step permits to obtain a further significant reduction in the formation of foam when the bottle 2 itself is released at atmospheric pressure.

Figure 6:
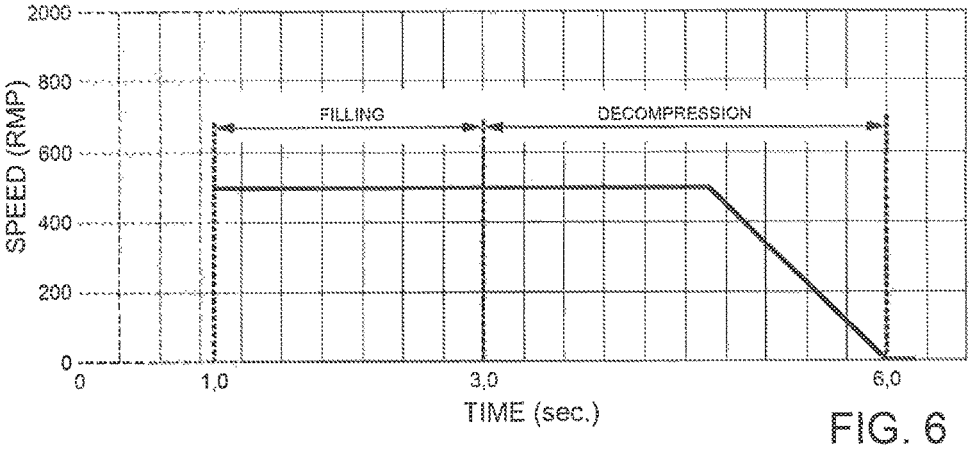
FIGS. 6 to 8 are graphs showing the variations, in the course of time, of the rotation speeds of different types of bottles during two consecutive steps of the filling method performed on the FIG. 1 machine with different types of pourable products.

The graph of FIG. 6 shows a first possible example of the variation of the angular speed of one type of bottle 2 during the filling step with a given type of carbonated soft drink and during the subsequent decompression step.

As shown, the angular speed of the bottle 2 is maintained constant during the filling step at about 500 rpm; during a first part of the decompression step, the angular speed of the bottle 2 is still maintained constant at the same value as the filling step, and is then progressively reduced to stop it at the end of the decompression step.

Figure 7:
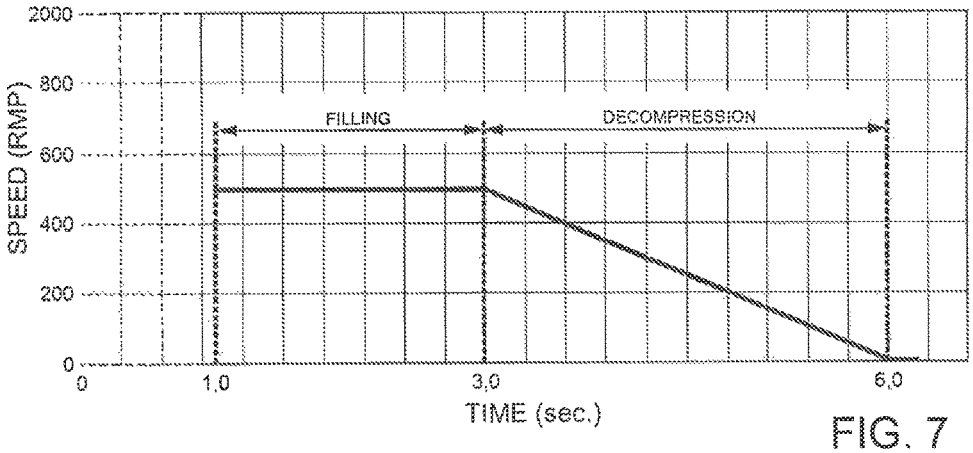

The graph of FIG. 7 shows a second possible example of the variation of the angular speed of another type of bottle 2 during the filling step with another type of carbonated soft drink and during the subsequent decompression step.

As shown, even in this case, the angular speed of the bottle 2 is maintained constant during the filling step at about 500 rpm; during the decompression step, the angular speed of the bottle 2 is progressively reduced from the value kept during the filling step to zero at the end of such step.

Figure 8:
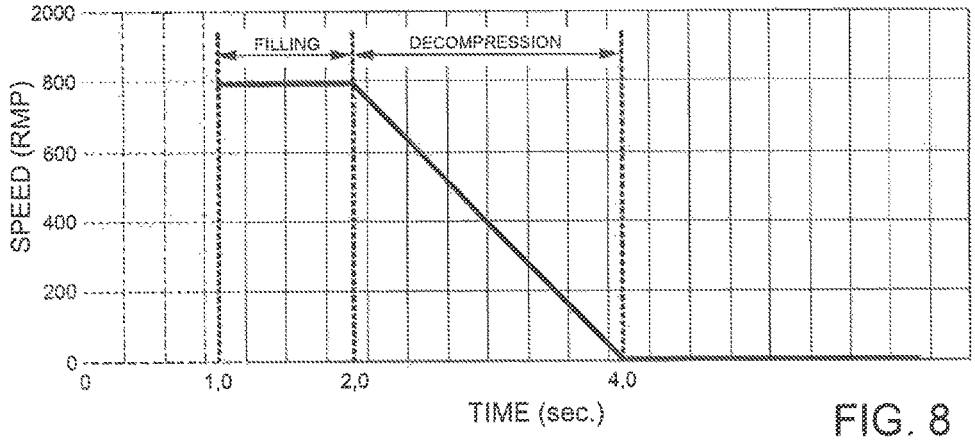

The graph of FIG. 8 shows a third possible example of the variation of the angular speed of another type of bottle 2 during the filling step with a non-carbonated pourable product and during the subsequent decompression step.

As shown, in this case, the angular speed of the bottle 2 is maintained constant during the filling step at about 750 rpm; during the decompression step, the angular speed of the bottle 2 is progressively reduced from the value kept during the filling step to zero at the end of such step.

As a general rule, each bottle 2 is subjected to a deceleration during the decompression step from the angular speed kept at the end of the filling operation to a complete stop of such bottle 2 at the end of the decompression step itself.

All these variation in the angular speed of each bottle 2 during filling and decompression are controlled by control unit 75 through suitable commands imparted to the relative electric motor 41.

Operation of machine 1 will now be described with reference to the filling of one bottle 2, and therefore to one handling unit 12, and as of the instant in which such bottle 2 is received by support device 13 of the handling unit 12 from input star wheel 7 in order to be filled with the pourable product.

In this condition, the bottle 2 is centered with respect to filling device 14 by moving, under the thrust of piston 50, filling head 51 from the rest position to the lowered operating position. In particular, gasket 52 of filling head 51 contacts top neck 4 of the bottle 2, which reaches a position coaxial with the filling head 51 itself. In practice, the axis A of the bottle 2 is coaxial with the axis E of handling unit 12.

At this point, valve 31 of pressurization circuit 30 is opened (valve 23 of product circuit 22 and valve 64 of decompression circuit 62 are in a closed condition) and is maintained in that condition up to the moment in which pressure in the bottle 2 reaches a given first value H1, for instance about 1.5 bar, adapted to make the bottle 2 sufficiently rigid for labelling. Then, valve 30 is closed.

In the meantime, the handling unit 12 reaches transfer station 67, where a label 66 is supplied by labelling unit 65 to the bottle 2; in order to allow application of the label 66 on the bottle 2, the latter is rotated about its axis A by activating electric motor 41. In particular, in this stage, rotary motion imparted by output shaft 42 of electric motor 41 to gripping member 36 through gears 43, 44 is transmitted to the bottle 2 and from the latter to the passive rotary portion Z of the handling unit 12, which is in contact with the top neck 4 of the bottle 2.

Once the label 66 has been applied on bottle 2, in the case in which the pourable product to be fed into the bottle 2 is a carbonated liquid, a further pressurization step is carried out; even in this case, valve 31 of pressurization circuit 30 is opened and maintained in the open condition up to the moment in which pressure in the bottle 2 reaches a given second value H2, for instance about 6 bar, higher than first value H1 and defining the requested condition for the filling operation with the carbonated liquid. Then, the valve 31 is again closed.

By opening valve 23 of product circuit 22, the actual filling of the bottle 2 with the product can be started (shutter 19 is normally kept by spring 24 in the raised opening position). This step ends when the product reaches the desired level in the bottle 2.

During this step, electric motor 41 is again activated to rotate the bottle 2 about its axis A. Therefore, the bottle 2 is subjected to a revolution motion about axis B and a rotary motion about axis A. Thanks to this double rotation about axes A and B, the bottle 2 can be filled at high speed with a reduced formation of foam. As a matter of fact, the centrifugal force caused by this additional rotation about axis A generates an additional pressure on the product in the bottle 2, which entraps the carbon dioxide into the product. Moreover, the product comes down into the bottle 2 along the lateral wall thereof instead of centrally.

The next step is the decompression of the bottle 2, which is achieved by connecting the bottle 2 with decompression circuit 62.

Also in this step, the bottle 2 is rotated about its axis A, by maintaining electric motor 41 in an activation step. In particular, during the decompression step, the bottle 2 is progressively decelerated and is definitively stopped at the end of this step.

The applicant has observed that, by rotating the bottle 2 during the decompression step, a further reduction of the formation of the foam can be achieved with a consequent relevant reduction of the overall time to complete the filling operation of the bottle 2.

At this point, the filling head 51 can be moved to the rest position.

In the case in which the pourable product delivered to the bottle 2 is a non-carbonated liquid, the second pressurization step is not performed.

Figure 9:
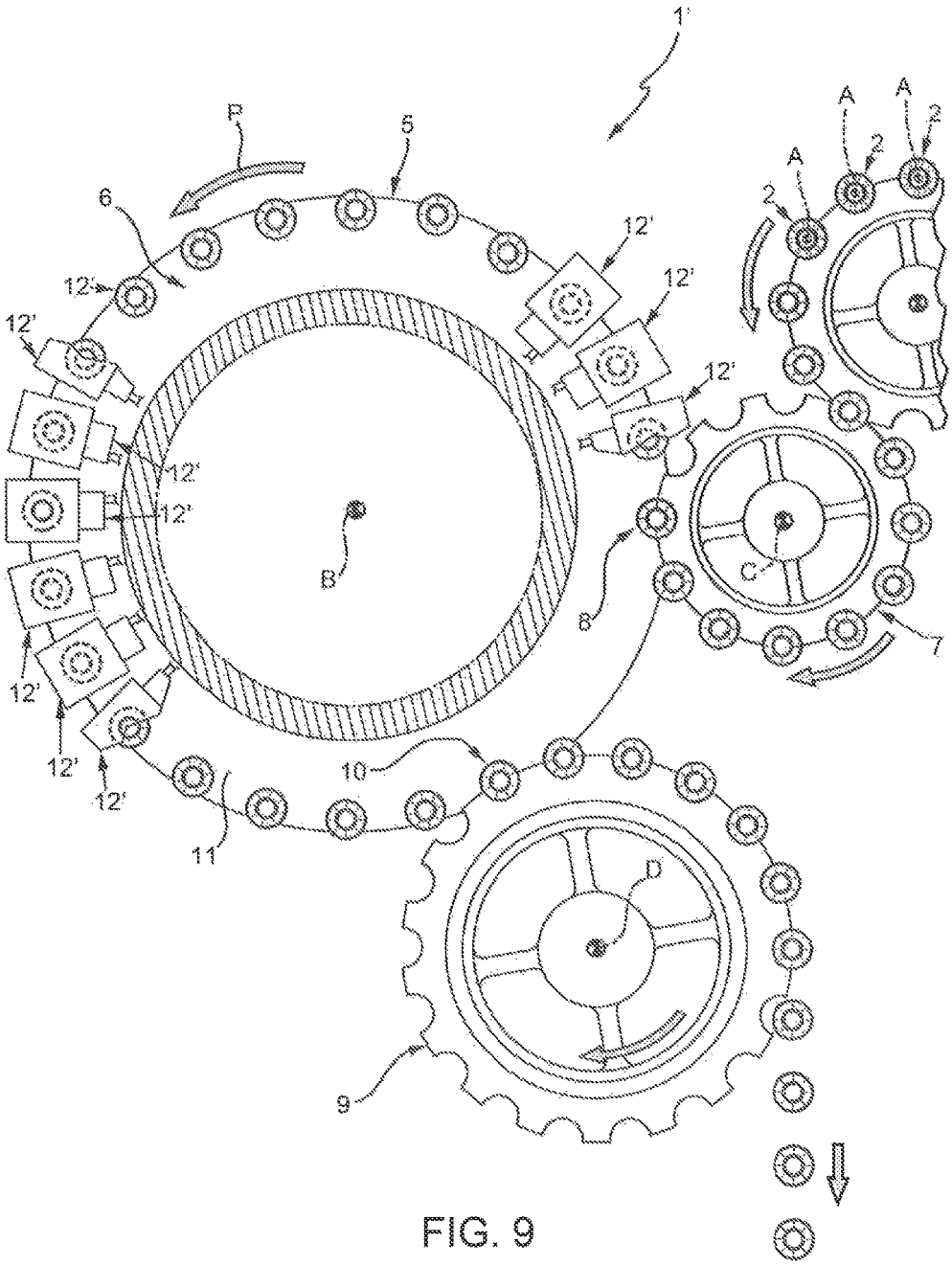
FIG. 9 shows a schematic top plan view, with parts removed for clarity, of a second embodiment of a machine according to the present invention for filling bottles with a pourable product.

Number 1' in FIG. 9 indicates as a whole a different embodiment of a machine according to the present invention for filling containers, in particular bottles 2, with pourable products, in particular carbonated liquids; machine 1 and 1' being similar to one another, the following description is limited to the difference between them, and using the same references, where possible, for identical or corresponding parts.

In particular, machine 1' differs from machine 1 basically by being lacking in labelling unit 65 and by including a plurality of handling units 12' (FIG. 10) different from the corresponding handling units 12.

Figure 10:
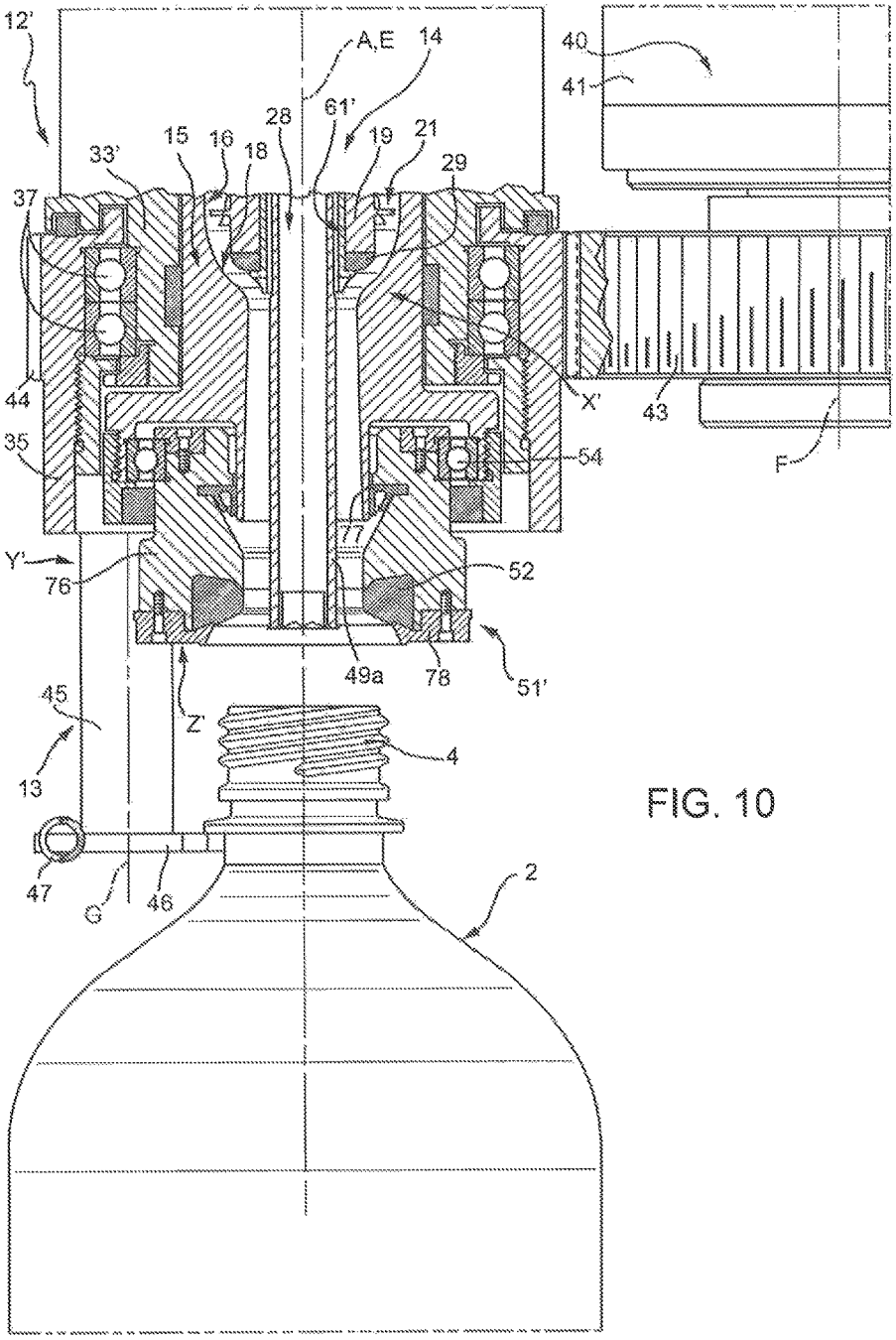
FIG. 10 shows a larger-scale, sectioned side view, with parts removed for clarity, of a handling assembly of the FIG. 9 machine for carrying and filling a relative bottle.

With particular reference to FIG. 10, each handling unit 12' has an active rotary portion Y', perfectly equivalent to active rotary portion Y of the respective handling unit 12, and a fixed portion X', in which a tubular element 33' replaces cylinder 33 and is directly secured to post 15, without interposing piston 50.

In this case, each handling unit 12' has a passive rotary portion Z', in which the gasket 52 is secured to an annular element 76, in turn cooperating with lower narrow end 34 of the relative post 15 through an elastomeric gasket 77.

In particular, the gasket 52 of each handling unit 12' is sandwiched between annular element 76 and an annular disk-shaped cover 78, secured to the annular element 76 itself. Gasket 52, annular element 76 and cover 78 define a filling head 51' of the relative handling unit 12'.

As clearly shown in FIG. 10, in each handling unit 12', gasket 77 is axially interposed between the gasket 52, destined to cooperate with the relative bottle 2, and the gasket 29 of the shutter 19 cooperating with lower narrow portion 18 of inner surface 16 of the post 15 in the lowered closing position of the shutter 19 itself.

Gasket 77 rotates in use with the relative annular element 76 under the thrust of the bottle 2 and slides on lower narrow end 34 of the relative post 15 ensuring sealing thereof.

Arranging gasket 77 in the specified position in the relative handling unit 12' allows to avoid using a mechanical gasket 57 like in corresponding handling unit 12.

As visible in FIG. 10, the filling head 51' of each handling unit 12' axially protrudes downwards, i.e. towards the relative jaws 46, with respect to the relative bell 35.

In addition, in the solution of FIG. 10, each handling unit 12' comprises a decompression conduit 61' formed within the relative shutter 19 around the conduit 28; in particular, decompression conduit 61' has an annular configuration and is connected to decompression circuit 62.

Operation of machine 1' is perfectly equivalent to that described with reference to machine 1.

Figure 11:
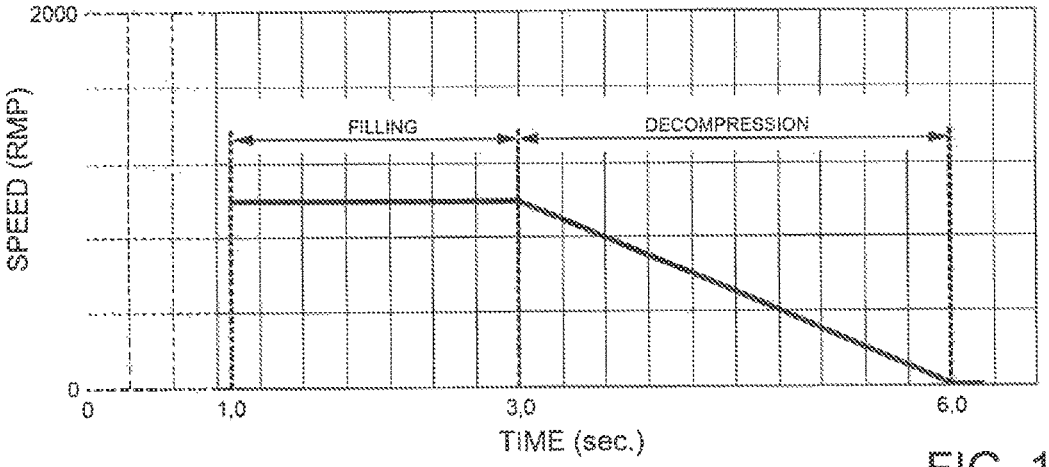
FIG. 11 is a graph analogous to those of FIGS. 6 to 8 and showing the variation, in the course of time, of the rotation speed of a bottle during two consecutive steps of the filling method performed on the FIG. 9 machine.

The graph of FIG. 11 refers to machine 1' and shows the variation of the angular speed of bottle 2 during the filling step with a given carbonated soft drink and during the subsequent decompression step.

As shown, the angular speed of the bottle 2 is maintained constant during the filling step at about 500 rpm; during a first part of the decompression step, the angular speed of the bottle 2 is still maintained constant at the same value as the filling step, and is then progressively reduced to stop it at the end of the decompression step.

The advantage of machines 1, 1' and the method according to the present invention will be clear from the foregoing description.

In particular, the rotation of each bottle 2 about its axis A not only during the actual filling but also during the decompression step permits to drastically reduce the formation of foam and therefore to increase the filling speed.

Clearly, changes may be made to machines 1, 1' and he method as described herein without, however, departing from the scope of protection as defined in the accompanying claims.

The invention claimed is:

1. A machine for filling containers, each container having a longitudinal axis, the machine comprising:

a conveying device;

at least one handling unit configured to be fed by the conveying device along a transfer path, the at least one handling unit including a support device configured to receive and retain a container and at least one filling device selectively activated for feeding a pourable product into the container while the at least one handling unit travels along the transfer path;

a pressurizing circuit selectively in communication with the container advancing along the transfer path to feed an operative fluid that is pressurized at a pressure higher than atmospheric pressure into the container;

a decompression circuit selectively in communication with the container advancing along the transfer path to discharge excess pressure with respect to the atmospheric pressure, after completion of the filling of the container with the pourable product;

at least one actuating device selectively switched to an active state to rotate the container about the longitudinal axis while the container is advanced along the transfer path; and a control unit configured to:

control activation and deactivation of the at least one filling device and the at least one actuating device;

control connection of the pressurization circuit and the decompression circuit with the container; and simultaneously maintain the at least one actuating device in an active state while the decompression circuit is in communication with the container so as to rotate the container about the longitudinal axis during decompression.

2. The machine as claimed in claim 1, wherein the control unit is configured to maintain the at least one actuating device in the active state while the at least one filling device is activated so as to rotate the container about the longitudinal axis during filling with the pourable product.

3. The machine as claimed in claim 1, wherein the at least one actuating device is controlled by the control unit to decelerate the container during decompression.

4. The machine as claimed in claim 2, wherein the at least one actuating device is controlled by the control unit to maintain, during a first part of the decompression, the same angular speed of the container at the end of the filling, and to decelerate the container during a second part of the decompression.

5. The machine as claimed in claim 1, wherein the conveying device includes a conveyor carousel mounted to rotate about an axis to define the transfer path.

6. The machine as claimed in claim 1, wherein the at least one actuating device includes a motor carried by the conveying device and having an output shaft coupled to the support device so as to cause the rotation of the container about the longitudinal axis.

7. The machine as claimed in claim 1, wherein the at least one filling device includes a filling head for pouring the pourable product into the container.

8. The machine as claimed in claim 7, wherein the at least one filling device includes a hollow supporting element secured to the conveying device, and wherein the filling head is coupled to the hollow supporting element in a rotatable manner about a rotation axis coaxial with the longitudinal axis of the container.

9. The machine as claimed in claim 8, wherein the at least one handling unit includes a shutter engaging the hollow supporting member in an axially displaceable manner, defining with an inner surface of the hollow supporting member a product feeding conduit and including, on an outer surface, a first elastomeric gasket configured to cooperate with a narrow inner section of the inner surface of the hollow supporting member in a closing position of the shutter so as to seal the product feeding conduit.

10. The machine as claimed in claim 9, wherein the filling head has a second elastomeric gasket configured to cooperate with, and to externally seal, a mouth of the container, and wherein the filling head cooperates with an outer surface of the hollow supporting member through a third elastomeric gasket axially interposed between the first and second elastomeric gaskets.

11. The machine as claimed in claim 1, further comprising a labelling unit arranged peripherally with respect to the conveying device and configured to feed labels to the handling unit while the handling unit is advanced along the transfer path by the conveying device and passes by the labelling unit.

12. The machine as claimed in claim 1, wherein the support device includes an arm connected to jaws for gripping a neck of the container.

13. The machine as claimed in claim 1, wherein the control unit is configured to put the pressurizing circuit into communication with the container prior to activating the at least one filling device.

14. A method for filling containers, each container having a longitudinal axis, the method comprising:

advancing at least one handling unit along a transfer path;

feeding a container to the handling unit to be retained and advanced along the transfer path;

filling the container with a pourable product by activating at least one filling device of the handling unit while the handling unit is advanced along the path;

pressurizing the container to a pressure higher than atmospheric pressure while the handling unit is advanced along the transfer path;

performing decompression of the container by discharging excess pressure with respect to the atmospheric pressure while the handling unit is advanced along the transfer path and after completion of the filling of the container with the pourable product; and rotating the container about the longitudinal axis during decompression.

15. The method as claimed in claim 14, further comprising rotating the container about the longitudinal axis during filling of the container with the pourable product.

16. The method as claimed in claim 14, wherein the container is decelerated during decompression.

17. The method as claimed in claim 16, wherein, during a first part of the decompression, the container is rotated at the same angular speed as at the end of the filling and, during a second part of the decompression, the container is decelerated.

18. The method as claimed in claim 14, wherein pressurizing the container to a pressure higher than the atmospheric pressure, is carried out prior to filling the container with the pourable product.

* * * * *